US006997367B2

(12) United States Patent
Hu

(10) Patent No.: US 6,997,367 B2
(45) Date of Patent: Feb. 14, 2006

(54) HAND-HELD NAILING TOOL

(75) Inventor: Shih-Che Hu, Yung Kang (TW)

(73) Assignee: Yih Kai Enterprise Co., Ltd., Tainan Hsien (TW)

( * ) Notice: Subject to any disclaimer, the term of this patent is extended or adjusted under 35 U.S.C. 154(b) by 0 days.

(21) Appl. No.: 10/506,261

(22) PCT Filed: Jul. 25, 2002

(86) PCT No.: PCT/CN02/00518

§ 371 (c)(1),
(2), (4) Date: Aug. 30, 2004

(87) PCT Pub. No.: WO2004/011201

PCT Pub. Date: Feb. 5, 2004

(65) Prior Publication Data

US 2005/0082334 A1 Apr. 21, 2005

(51) Int. Cl.
*B25C 1/06* (2006.01)

(52) U.S. Cl. ..... 227/132; 227/131; 173/202

(58) Field of Classification Search ..... 227/132, 227/131, 129; 173/217, 202, 203
See application file for complete search history.

(56) References Cited

U.S. PATENT DOCUMENTS

| | | | | | |
|---|---|---|---|---|---|
| 4,033,500 | A | * | 7/1977 | Manganaro | 227/131 |
| 4,108,345 | A | * | 8/1978 | Manganaro | 227/131 |
| 4,530,454 | A | * | 7/1985 | Gloor et al. | 227/129 |
| 4,583,600 | A | * | 4/1986 | Smith, III | 173/124 |
| 4,724,992 | A | * | 2/1988 | Ohmori | 227/146 |
| 4,811,885 | A | * | 3/1989 | Lai | 227/131 |
| 4,834,278 | A | * | 5/1989 | Lin | 227/7 |
| 5,004,140 | A | * | 4/1991 | Fushiya et al. | 227/8 |
| 5,118,023 | A | * | 6/1992 | Fushiya et al. | 227/8 |
| 5,503,319 | A | * | 4/1996 | Lai | 227/132 |
| 5,605,268 | A | * | 2/1997 | Hayashi et al. | 227/8 |
| 5,720,423 | A | * | 2/1998 | Kondo et al. | 227/130 |

* cited by examiner

*Primary Examiner*—Scott A. Smith
(74) *Attorney, Agent, or Firm*—Pro-Techtor Int'l Services

(57) ABSTRACT

A handy electric nailing gun includes a firing pin, a firing spring for pushing the firing pin to drive nails into workpiece, an output gear rotatable by a motor through a transmission gear set to retract the firing pin during the first half run of each rotation cycle and to release the firing pin during the second half run of each rotation cycle, and three power switches electrically connected in series between the motor and the power source (AC adapter/rechargeable battery) for operation by the user to control the operation of the motor.

9 Claims, 10 Drawing Sheets

A-A'

HAND-HELD NAILING TOOL

BACKGROUND OF THE INVENTION

1. Field of the Invention

The present invention relates to an electric nailing gun and more particularly, to a handy electric nailing gun, which retracts the firing pin during first half run of each rotation cycle of the output gear and release the firing pin to drive one nail out of the housing during second half run of each rotation cycle of the output gear.

2. Description of the Related Art

Various power nailing guns have been disclosed, and have appeared on the market. These power nailing guns are designed to work with an air compressor. However, an air compressor for this purpose is heavy and not highly movable. Therefore, conventional power nailing guns are not suitable for home use.

SUMMARY OF THE INVENTION

The present invention has been accomplished under the circumstances in view. It is therefore the main object of the present invention to provide an electric nailing gun, which is handy and convenient for home use. According to one aspect of the present invention, the handy electric nailing gun comprises a housing, the housing comprising handhold means for holding by hand, an elongated nail chamber adapted to accommodate nails, the nail chamber having an inner close end and an outer open end, a follower spring installed in the inner close end of the nail chamber and adapted to push loaded nails toward the outer open end of the nail chamber, a barrel perpendicularly aimed at the outer open end of the nail chamber; a power unit, the power unit comprising a power source, a first power switch, and a second power switch, the first power switch and the second power switch being electrically connected in series to the power source and each having a switching rod; a transmission unit, the transmission unit comprising a motor electrically connected to the power unit, a transmission gear set rotatable by the motor, and an output gear meshed with the transmission gear set and rotatable by the transmission gear set upon operation of the motor, the output gear having a series of teeth arranged around a part of the periphery thereof and a push rod; a striking mechanism controllable by the transmission unit to drive nails out of the nail chamber, the striking mechanism comprising a firing pin, the firing pin having a longitudinal rack formed integral with the periphery thereof for engagement with the teeth of the output gear, and a firing spring connected between one end of the firing pin and a part inside the housing and adapted to push the firing pin toward the outer open end of the nail chamber to drive one nail out of the nail chamber after disengagement of the rack from the teeth of the output gear; and a control unit adapted to control on/off of the power unit, the control unit comprising a first control button adapted to press the switching rod of the first power switch and to further switch on the first power switch, a second control button adapted to control on/off status of the second power switch, a press member coupled to the housing and pressed on the switching rod of the second power switch to switch off the second power switch, the press member having an elongated coupling hole coupled to a pivot pin inside the housing, a push block controllable by the second control button to move the press member away from the switching rod of the second power switch and to further switch on the second power switch, and a return spring adapted to return the press member after the press member has been moved away from the switching rod of the second power switch by the push block. According to another aspect of the present invention, the power source can be an AC adapter or rechargeable battery, or their combination.

BRIEF DESCRIPTION OF THE DRAWINGS

FIG. 11 is similar to FIG. 7 but showing the actuating rod depressed and the third power switch switched on.

DETAILED DESCRIPTION OF THE PREFERRED EMBODIMENT

Figure 1:
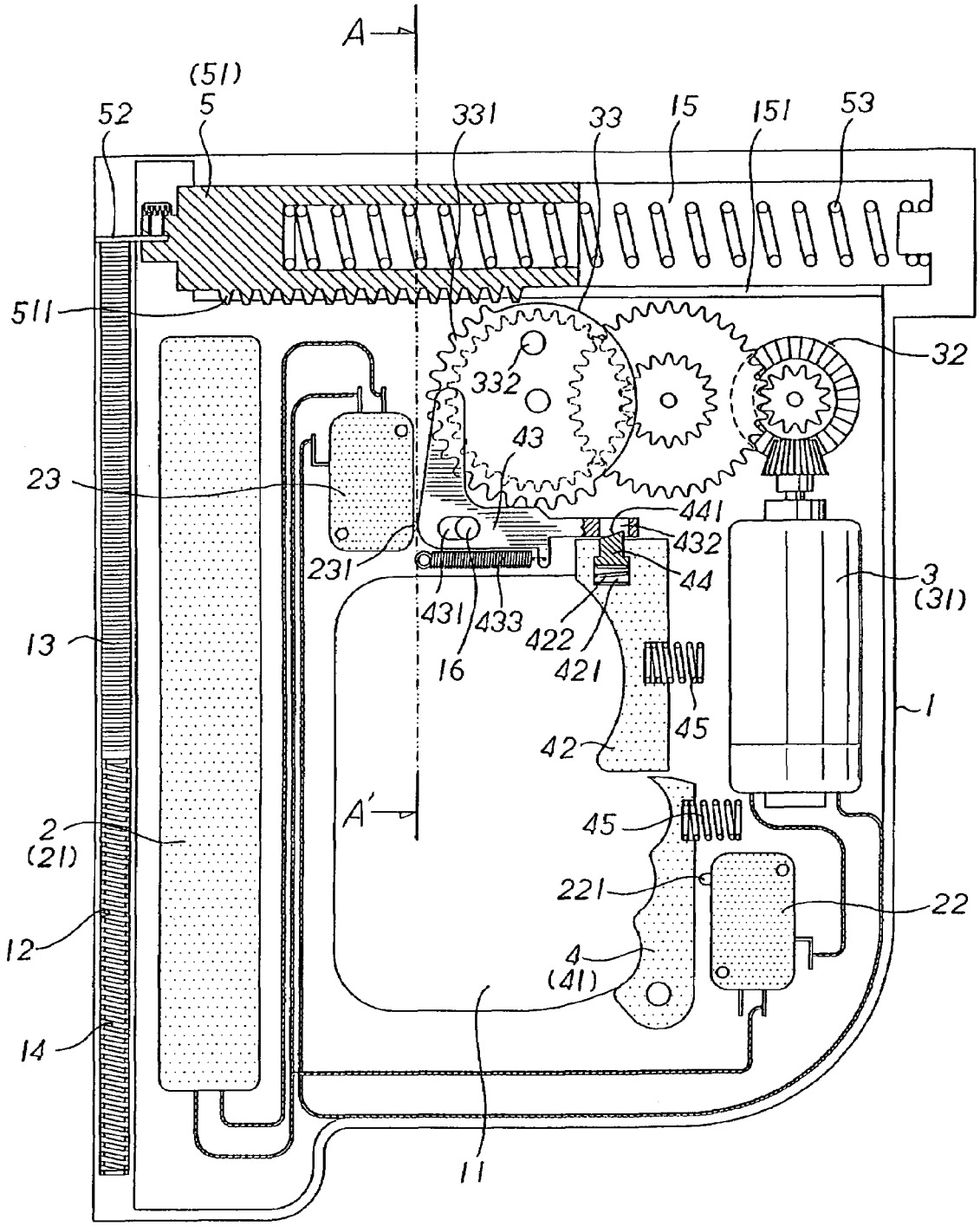
FIG. 1 is a plain view of a handy electric nailing gun according to the present invention.

Referring to FIG. 1, a handy electric nailing gun in accordance with the present invention is shown comprised of a housing 1, a power unit 2, a transmission unit 3, a control unit 4, and a striking mechanism 5.

The housing 1 comprises handhold means, for example, a hand hole 11 through which the user can hold the nailing gun with the hand, an elongated nail chamber 12 and a barrel 15 arranged at right angles, a follower spring 14 installed in one end, namely, the inner end of the nail chamber 12 and adapted to push a bar of nails 13 forward toward the other end, namely, the outer end of the nail chamber 12, and a longitudinal slot 151 in one side, namely, the bottom side of the barrel 15. The barrel 15 accommodates the striking mechanism 5.

Figure 2:
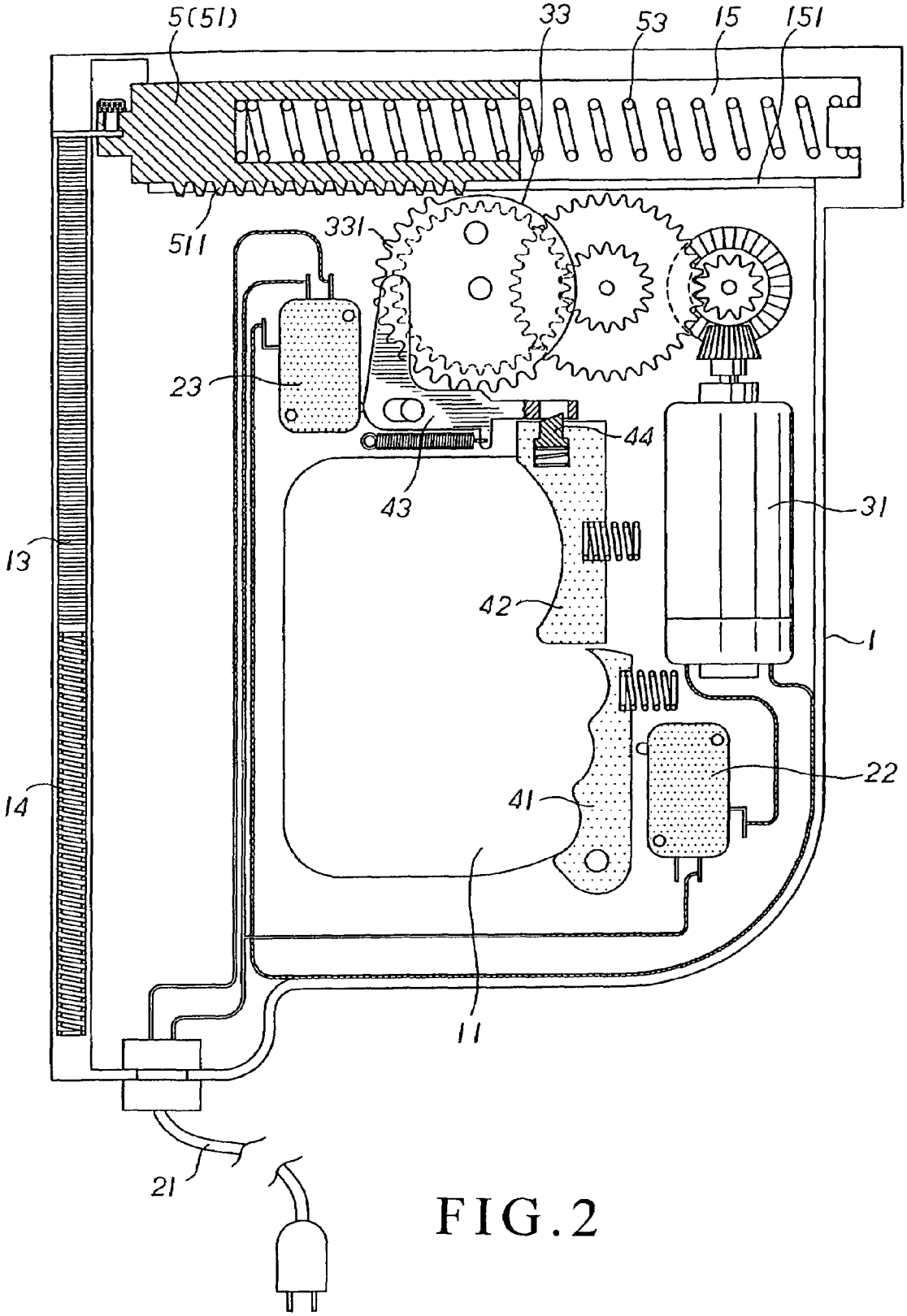
FIG. 2 is similar to FIG. 1 but showing the handy electric nailing gun equipped with an AC adapter.

The power unit 2 comprises a power source 21, a first power switch 22, and a second power switch 23. The power source 21 can be an AC adapter (see FIG. 2), or a rechargeable battery (see FIG. 1). The first power switch 22 and the second power switch 23 are electrically connected to the power source 21, each having a switching rod 221 or 231. The first power switch 22 is switched on when the switching rod 221 of the first power switch 22 is pressed. The second power switch 23 is switched off when the switching rod 231 of the second power switch 23 is pressed. Because the circuit design of the power unit 2 is of the known art, no further detailed description in this regard is necessary.

The transmission unit 3 comprises a motor 31, a transmission gear set 32, and an output gear 33. The motor 31 is electrically connected to the power unit 2 and controlled to rotate the transmission gear set 32 by the power unit 2. The transmission gear set 32 is a speed changing (speed reduction) gear set driven by the motor 31 to rotate the output gear 33. The output gear 33 has teeth 331 arranged around only a part, for example, one half of the periphery, and a push rod 332 perpendicularly extended from one side thereof. The output gear 33 is adapted to retract the firing pin 51 of the striking mechanism 5. Therefore, the number of the teeth 331 of the output gear 33 is determined subject to the designed retract stroke of the firing pin 51 of the striking mechanism 5.

Figure 3:
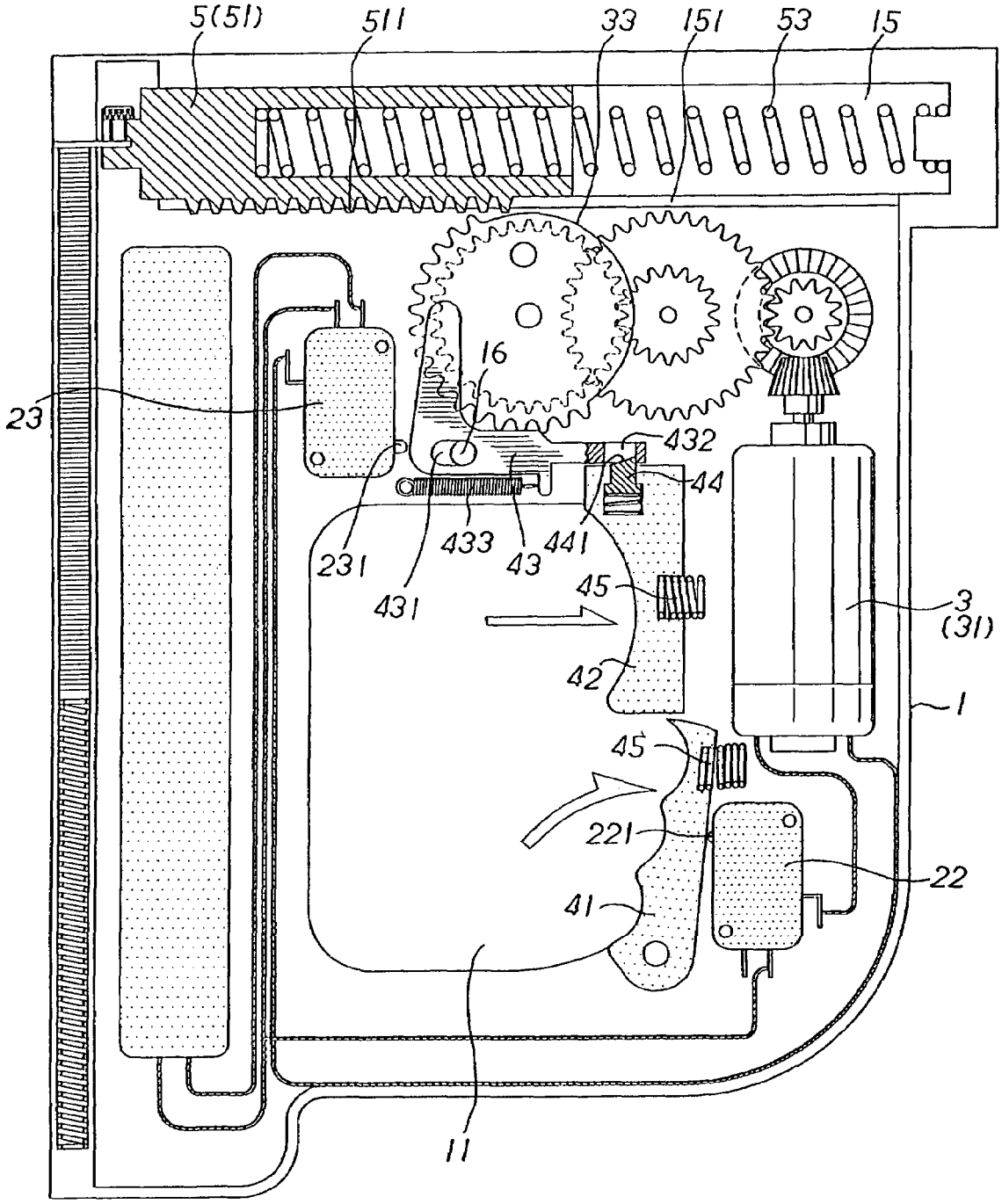
FIG. 3 is a schematic plain view of the present invention, showing the first control button and the second control button of the handy electric nailing gun pressed.
Figure 5:
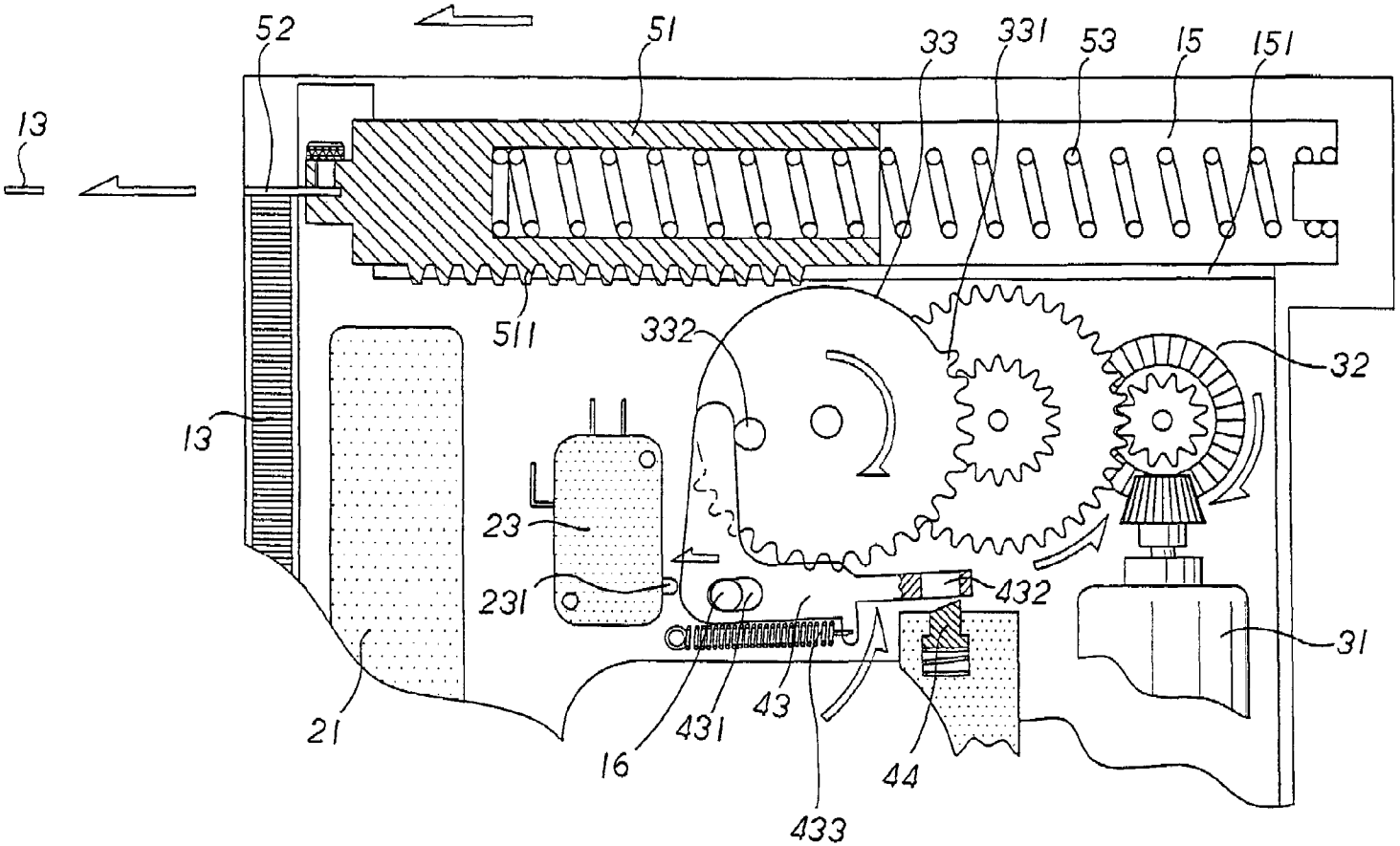
FIG. 5 is a schematic plain view of the present invention, showing the firing pin rushed forwards and one nail driven out of the housing.
Figure 6:
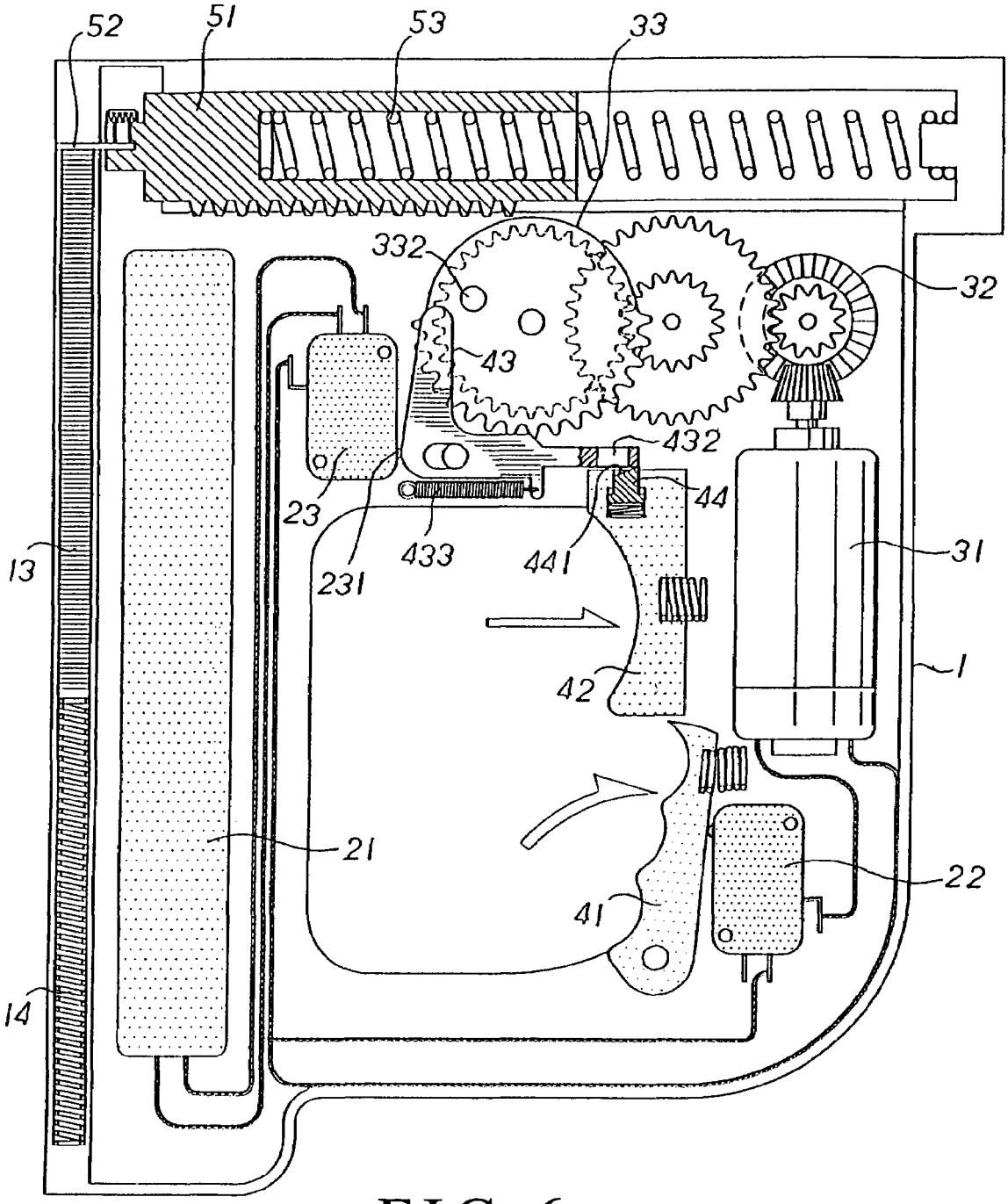
FIG. 6 is a schematic plain view of the present invention, showing the press member returned after one firing cycle.
Figure 7:
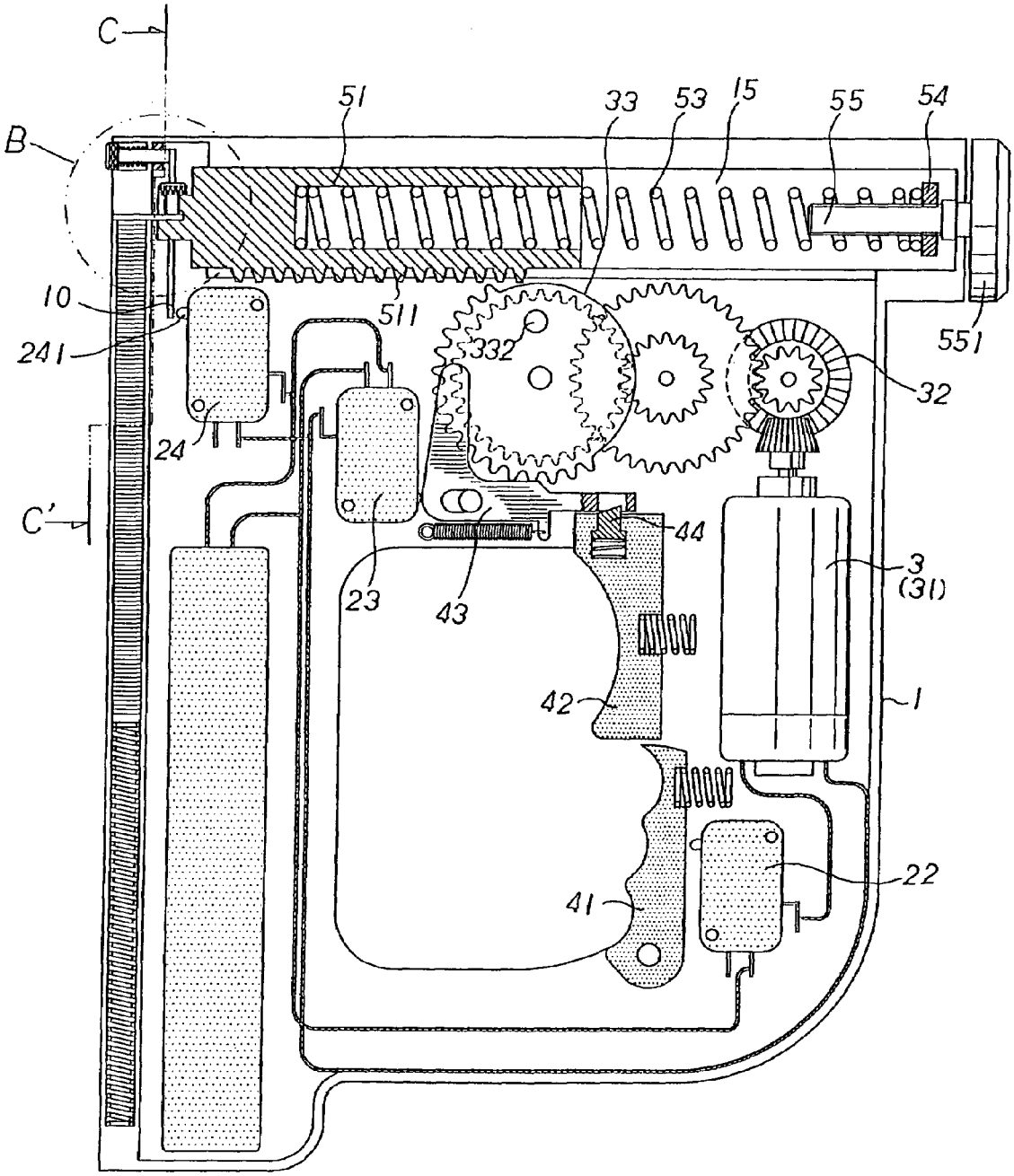
FIG. 7 is a plain view of an alternate form of the handy electric nailing gun according to the present invention.

The control unit 4 comprises a first control button 41, a second control button 42, a press member 43, a push block 44, and a return spring 433. The first control button 41 and the second control button 42 are respectively mounted in the hand hole 11 at one side, each have one end, namely, the first end pivoted to the housing 1 and the other end, namely, the free end supported on a respective spring member 45. The first control button 41 is adapted to drive the switching rod 221 of the first power switch 22, thereby switching on the first power switch 22 (see FIG. 3). The second control switch 42 has a receiving hole 421 formed in the free end and accommodating a spring member 422, which supports the push block 44. The push block 44 has a beveled front guide edge 441. The press member 43 is a curved, for example, L-shaped member having an elongated slot 431 formed in a middle part thereof and coupled to a pivot pin 16 inside the housing 1, a locating hole 432 formed in one end thereof and adapted to receive the push block 44. The return spring 433 is connected between one end of the press member 43 and the housing 1, holding the press member 43 pressed on the switching rod 231 of the second power switch 23 to switch off the second power switch 23 (see FIG. 1). The push block 44 is inserted into the locating hole 432 of the press member 43, and adapted to move the press member 43 away from the switching rod 231 of the second power switch 23 and to further switch on the second power switch 23 (see FIG. 3). When electricity is transmitting from the power unit 2 to the transmission unit 3, the motor 31 is started to rotate the output gear 33 via the transmission gear set 32, thereby causing the push rod 332 to push the press member 43. At this time, the press member 43 is turned about to the pivot pin 16 to disengage the locating hole 432 from the push block 44 (see FIG. 5), and the return spring 433 immediately returns the press member 43 to the position shown in FIG. 1, and therefore the switching rod 231 is pressed to switch off the second power switch 23. After the push rod 332 passed over the press member 43, the press member 43 is turned about the pivot pin 16 in the reversed direction to the position shown in FIG. 6.

Figure 8:
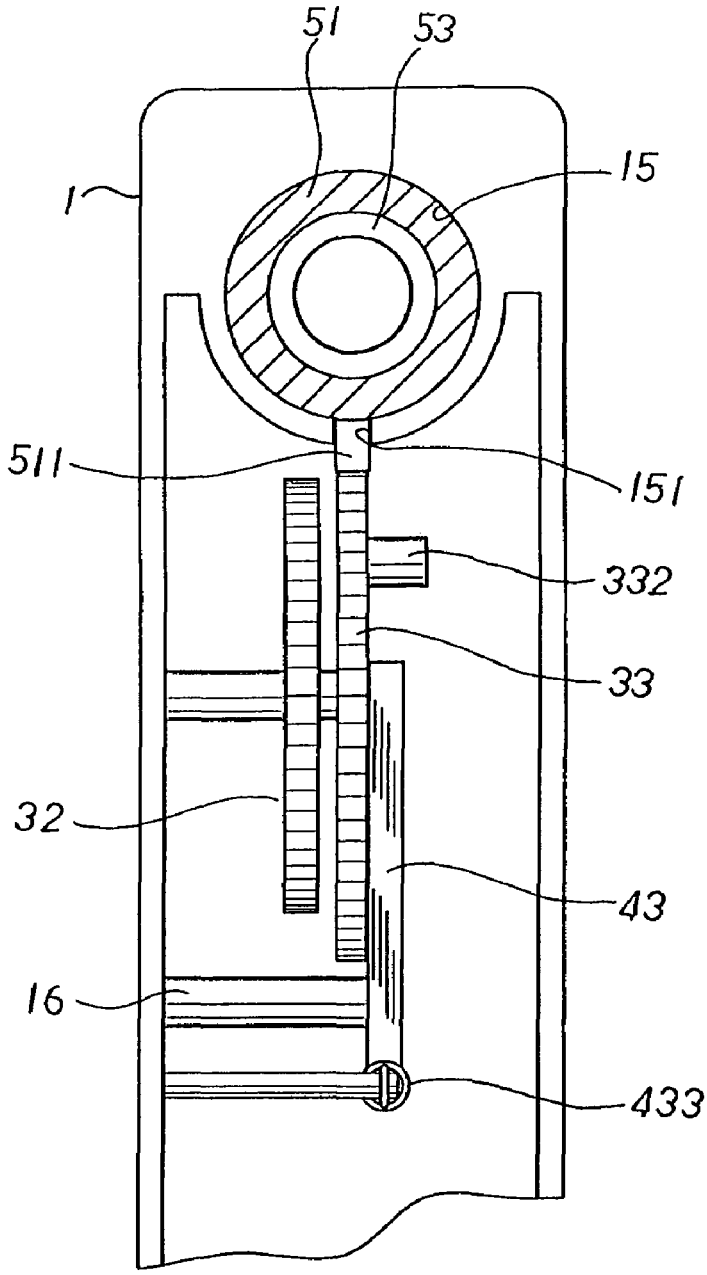
FIG. 8 is a sectional view taken in an enlarged scale along line A–A' of FIG. 7.
Figure 9:
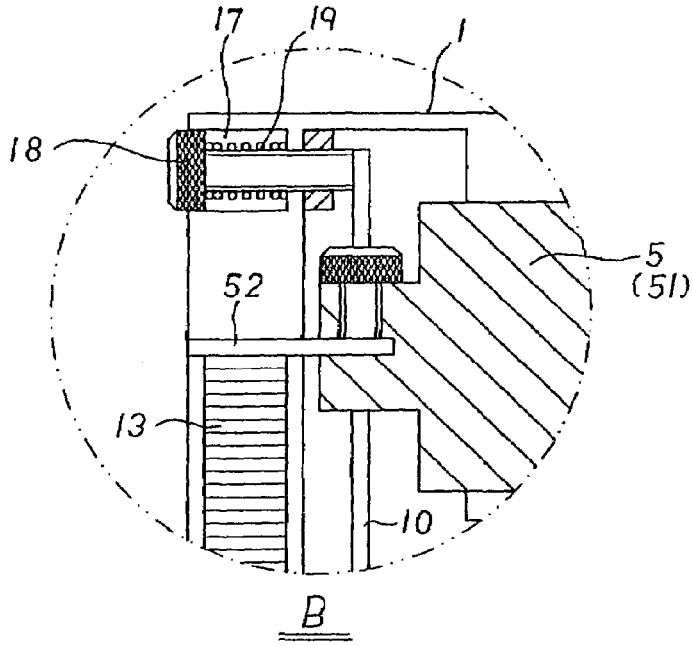
FIG. 9 is an enlarged view of part B of FIG. 7.
Figure 10:
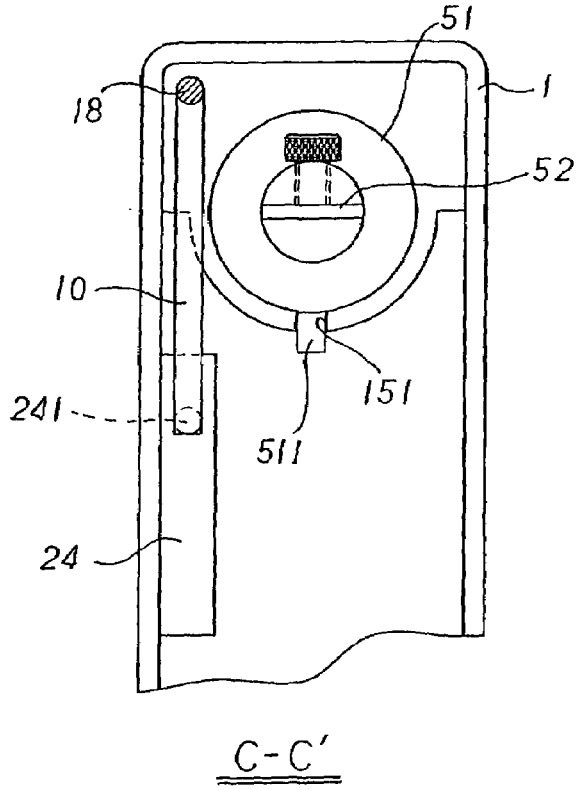
FIG. 10 is a sectional view taken in an enlarged scale along line C–C' of FIG. 7.
Figure 11:
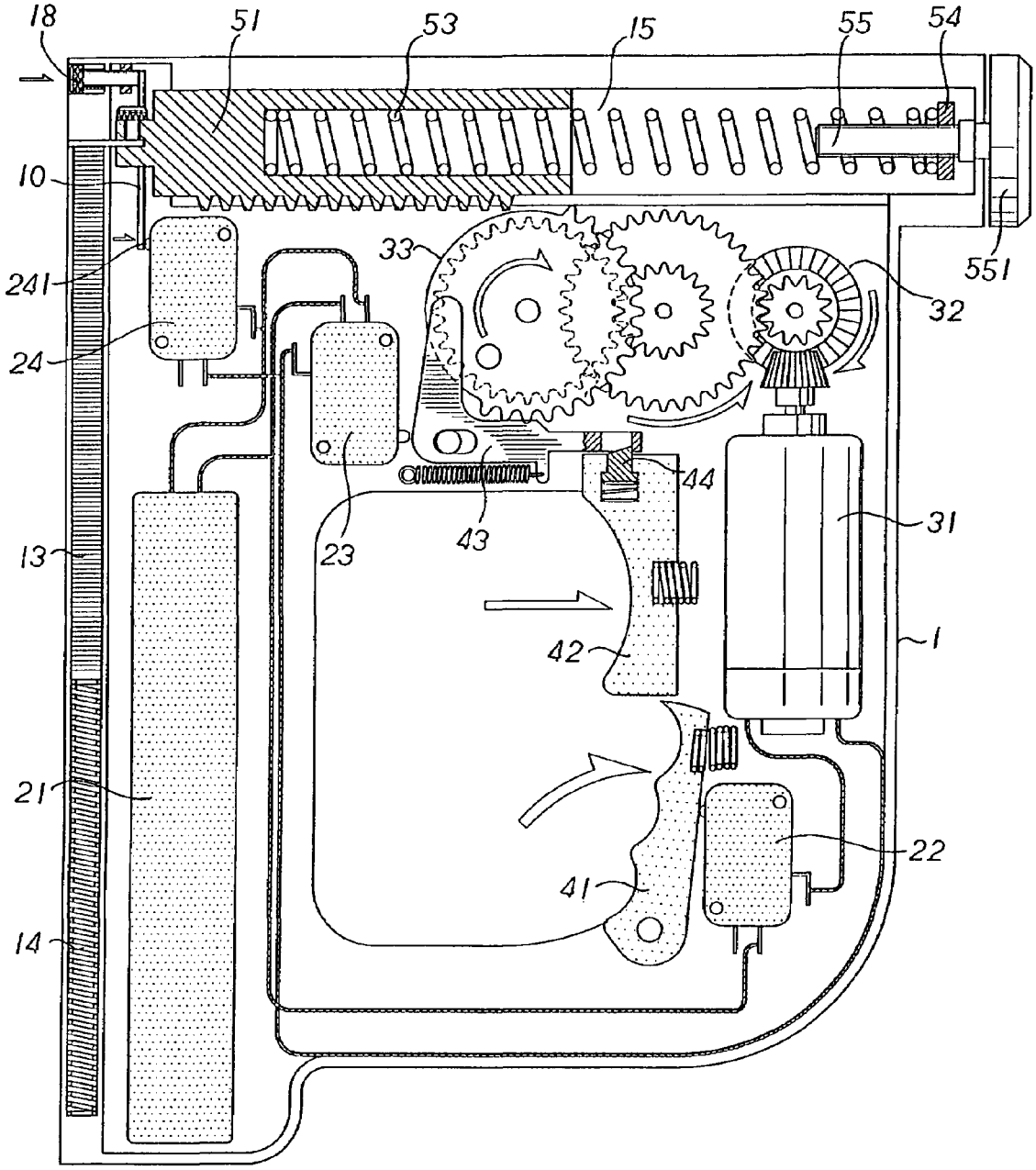

The striking mechanism 5 comprises the aforesaid firing pin 51, a tip 52, and a firing spring 53. The firing pin 51 is slidably mounted in the barrel 15, having a rack 511 formed integral with the periphery. The rack 511 is suspended in the longitudinal slot 151 and meshed with the teeth 331 of the output gear 33 (see also FIG. 8). The tip 52 is fixedly connected to the front end of the firing pin 51 for driving nails 13 out of the elongated nail chamber 12 into the workpiece. The firing spring 53 has the front end axially inserted into the inside of the firing pin 51 and fixedly connected thereto and the rear end connected to the inner side of the back wall of the barrel 15 (see FIG. 1).

Figure 4:
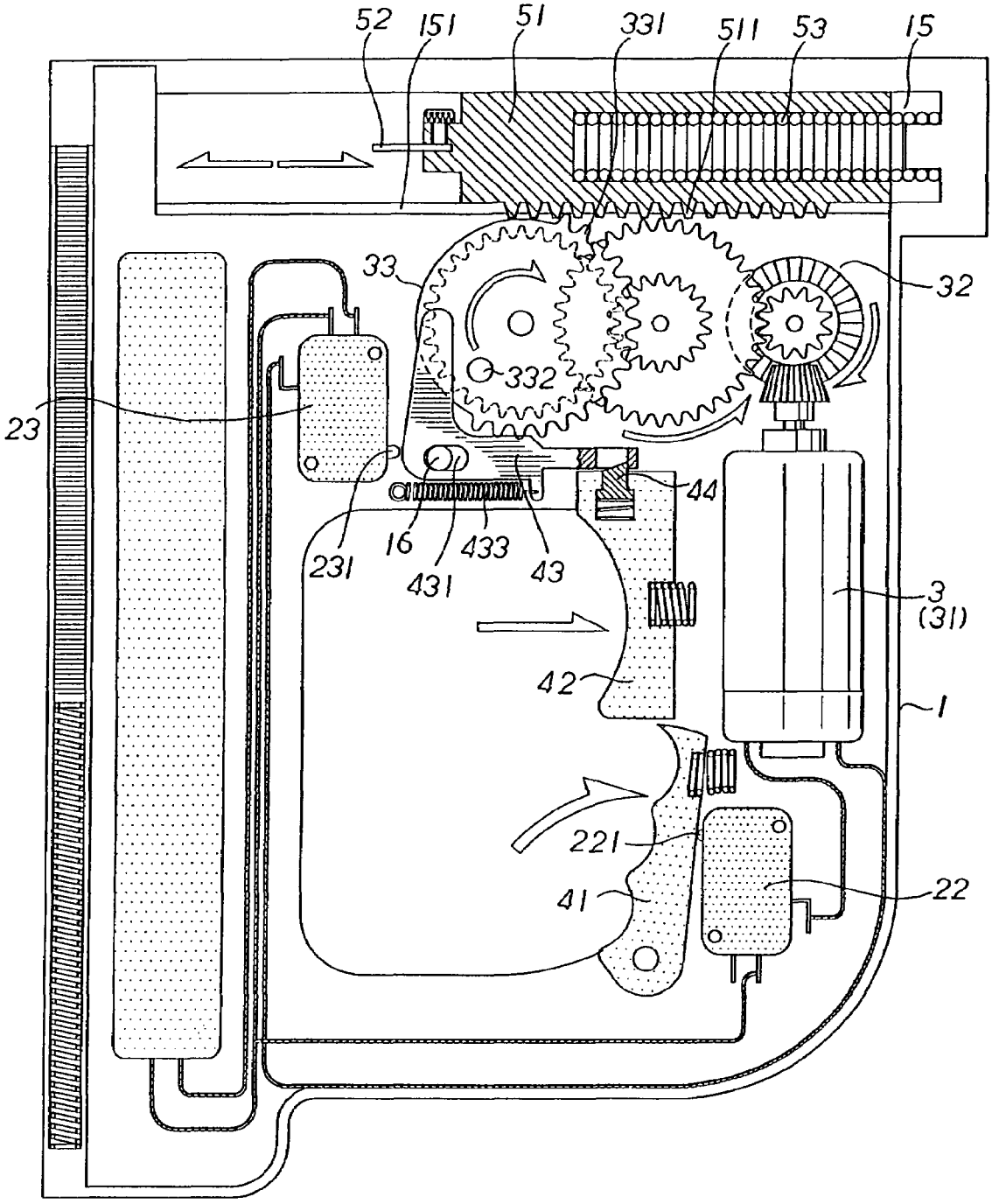
FIG. 4 is similar to FIG. 3 but showing the firing pin retracted.

When the user pressed the first control button 41 and the second control button 42 at the first time (see FIG. 3), the press member 43 is forced to move by the push block 44, and the return spring 433 is stretched to preserve spring force. At this time, the motor 31 is started to rotate the transmission gear set 32 and the output gear 33. During rotary motion of the output gear 33, the teeth 331 of the output gear 33 will be forced into engagement with the rack 511 of the firing pin 51 to move the firing pin 51 toward the back side of the barrel 15 (see FIG. 4). After the teeth 331 of the output gear 33 have been moved over the rack 511 of the firing pin 51, the firing spring 53 immediately pushes the firing pin 51 forwards in a rush, thereby causing the tip 52 to drive one nail 13 out of the housing 1 into the workpiece, completing one firing cycle (see FIG. 5). The output gear 33 is continuously rotated after firing of one nail 13. As soon as the push rod 332 of the output gear 33 touches the press member 43, the press member 43 will be turned about the pivot pin 16 to disengage the locating hole 432 from the push block 44. Immediately after disengagement of the press member 43 from the push block 44, the press member 43 will be returned by the return spring 433 to press on the switching rod 231 of the second power switch 23, thereby switching off power supply. After the push rod 332 of the output gear 33 moved over the press member 43, the press member 43 is released (see FIG. 6). When the user released the hand from the second control button 42, the spring member 422 immediately pushes the push block 44 into the locating hole 432 again (see FIG. 1), and one operation cycle is finished.

FIGS. 7~11 show an alternate form of the present invention. According to this alternate form, the rear end of the firing spring 53 is connected to a locating plate 54, which is threaded onto the threaded shank 55 of an adjustment screw 55 at the back side of the housing 1. Rotating the adjustment screw 55 clockwise/counter-clockwise causes the locating plate 54 to move forwards/backwards along the threaded shank 55, and therefore the spring force of the firing spring 53 is relatively adjusted. Further, the housing 1 has a hole 17 in the front side to accommodate a spring member 19 and an actuating rod 18. The actuating rod 18 is supported on the spring member 19, having an inner end fixedly connected to a press rod 10. The spring member 19 supports the actuating rod 18 in an extended position where the actuating rod 18 has one end, namely, the outer end projecting out of the housing 1. The press rod 10 is adapted to press the switching rod 241 of a third power switch 24. When the user pressed the actuating rod 18 against the workpiece, the press rod 10 is forced to press the switching rod 241 of the third power switch 24, thereby switching on the third power switch 24. The user can switch on the first power switch 22 and the second power switch 23 to start the transmission unit 3 only after the third power switch 24 has been switched on. The three power switches of the present invention ensure safety operation of the nailing gun.

A prototype of nailing gun has been constructed with the features of FIGS. 1~11. The nailing gun functions smoothly to provide all of the features discussed earlier.

Although particular embodiments of the invention have been described in detail for purposes of illustration, various modifications and enhancements may be made without departing from the spirit and scope of the invention.

What the invention claimed is:

1. A handy electric nailing gun comprising:

a housing, said housing comprising handhold means for holding by hand, an elongated nail chamber adapted to accommodate nails, said nail chamber having an inner closed end and an outer open end, a follower spring installed in the inner closed end of said nail chamber and adapted to push loaded nails toward the outer open end of said nail chamber, a barrel perpendicularly aimed at the outer open end of said nail chamber;

a power unit, said power unit comprising a power source, a first power switch, and a second power switch, said first power switch and said second power switch being electrically connected in series to said power source and each having a switching rod;

a transmission unit, said transmission unit comprising a motor electrically connected to said power unit, a transmission gear set rotatable by said motor, and an output gear meshed with said transmission gear set and rotatable by said transmission gear set upon operation of said motor, said output gear having a series of teeth arranged around a part of the periphery thereof and a push rod;

a striking mechanism controllable by said transmission unit to drive nails out of said nail chamber, said striking mechanism comprising a firing pin, said firing pin having a longitudinal rack formed integral with the periphery thereof for engagement with the teeth of said output gear, and a firing spring connected between one end of said firing pin and a part inside said housing and adapted to push said firing pin toward the outer open end of said nail chamber to drive one nail out of said nail chamber after disengagement of said rack from the teeth of said output gear; and a control unit adapted to control on/off of said power unit, said control unit comprising a first control button adapted to press the switching rod of said first power switch and to further switch on said first power switch, a second control button adapted to control on/off status of said second power switch, a press member coupled to said housing and pressed on the switching rod of said second power switch to switch off said second power switch, said press member having an elongated coupling hole coupled to a pivot pin inside said housing, a push block controllable by said second control button to move said press member away from the switching rod of said second power switch and to further switch on said second power switch, and a return spring adapted to return said press member after said press member has been moved away from the switching rod of said second power switch by said push block.

2. The handy electric nailing gun as claimed in claim 1, wherein said first control button and said second control button are respectively supported on a respective spring member in said housing.

3. The handy electric nailing gun as claimed in claim 2, wherein said output gear has a push rod perpendicularly extended from one side thereof and adapted to turn said press member about the pivot pin inside said housing between a first position where said press member is maintained engaged with said push block and movable away from the switching rod of said second power switch by said second control button and a second position where said press member is disengaged from said push block and not movable by said second control button; said push block has a beveled front guide edge.

4. The handy electric nailing gun as claimed in claim 1, wherein said barrel has a longitudinal slot for accommodating said rack of said firing pin.

5. The handy electric nailing gun as claimed in claim 1, wherein said power source is an AC adapter.

6. The handy electric nailing gun as claimed in claim 1, wherein said power source is a rechargeable battery.

7. The handy electric nailing gun as claimed in claim 1, wherein said press member has a receiving hole holding a spring member that supports said push block.

8. The handy electric nailing gun as claimed in claim 1, wherein said control unit further comprises a third power switch electrically connected in series between said power source and said second power switch, an actuating rod mounted in said housing movable in and out of said housing between an on position and an off position to switch on/off said third power switch, a spring member supporting said actuating rod in said on position, and a press rod fixedly connected to said actuating rod and movable with said actuating rod to switch on/off said third power switch.

9. The handy electric nailing gun as claimed in claim 1, wherein said striking mechanism further comprises a locating plate axially movably mounted in a rear side inside said barrel and stopped at one end of said firing spring against said firing pin, and an adjustment screw mounted in said housing for rotation by the user to move said locating plate in said barrel and to further adjust the spring force of said firing spring.

* * * * *